US005469636A

United States Patent [19]

Plomer

[11] Patent Number: 5,469,636

[45] Date of Patent: Nov. 28, 1995

[54] DEVICE FOR SELECTIVE TREATMENT OF MATERIAL WEBS

[75] Inventor: Anton Plomer, Heidenheim, Germany

[73] Assignee: J.M. Voith GmbH, Heidenheim, Germany

[21] Appl. No.: 229,173

[22] Filed: Apr. 18, 1994

[30] Foreign Application Priority Data

Apr. 27, 1993 [DE] Germany ..... 43 13 628.1

[51] Int. Cl.[6] ..... F26B 11/02

[52] U.S. Cl. ..... 34/117; 34/457; 34/458; 118/231; 118/235; 118/239; 162/135; 162/207; 162/359.1; 226/110

[58] Field of Search ..... 226/110; 118/231, 118/235, 239; 34/117, 457, 458; 162/135, 207, 359.1

[56] References Cited

U.S. PATENT DOCUMENTS 4,041,197 8/1977 Gagne ..... 427/278

5,291,666 3/1994 Babinsky et al. ..... 34/18

*Primary Examiner*—Henry A. Bennett
*Assistant Examiner*—Siddharth Ohri
*Attorney, Agent, or Firm*—Marshall, O'Toole, Gerstein, Murray & Borun

[57] ABSTRACT

A device for treating material webs includes first and second neighboring drying cylinders separated by an intermediate space. The intermediate space has a length substantially equal to about twice the diameter of the largest of the first and second cylinders. The device includes at least a first deflecting roll disposed in the intermediate space and in a path of a material web conveyed through the device. The device further includes at least a second deflecting roll disposed below a coating device and above the intermediate space. The second deflecting roll is adapted to feed a web of material upwardly into the coating device.

6 Claims, 1 Drawing Sheet

DEVICE FOR SELECTIVE TREATMENT OF MATERIAL WEBS

BACKGROUND OF THE INVENTION

1. Field of the Invention

The invention relates to devices for treating material webs and in particular to devices for treating material webs having drying cylinders cooperating with treatment apparatus such as coating, pigment, or sizing applicators.

2. Description of Related Technology

In machines which include the in-line treatment of running webs of material, such as those equipped with coating devices for applying coatings, pigments, and/or sizing onto a web of paper or cardboard, it is desirable to have the flexibility to optionally direct the web of material through the machine so as to bypass a certain coating device or devices. It can be difficult to rebuild existing machines to provide for means to bypass coating devices because of lack of space, for example, where the coating device to be bypassed cooperates with a group of drying cylinders of a paper machine.

SUMMARY OF THE INVENTION

It is an object of the invention to overcome one or more of the problems described above. It is also an object of the invention to provide a space-saving device which allows for the bypassing of a coating application device. Furthermore, it is an object of the invention to provide such a device in which the bypass route is short and the bypassing means is simply constructed.

A device according to the invention for treating material webs comprises first and second neighboring drying cylinders separated by an intermediate space. The intermediate space has a length substantially equal to about twice the diameter of the first or second cylinder. The device includes at least a first deflecting roll disposed in the intermediate space and in a path of a material web conveyed through the device. The device further includes at least a second deflecting roll disposed below the coating device and above the intermediate space. The second roll is adapted to feed a web of material upwardly into the coating device.

Other objects and advantages of the invention will be apparent to those skilled in the art from the following detailed description taken in conjunction with the drawing and the appended claims.

DETAILED DESCRIPTION OF THE INVENTION

Figure 1:
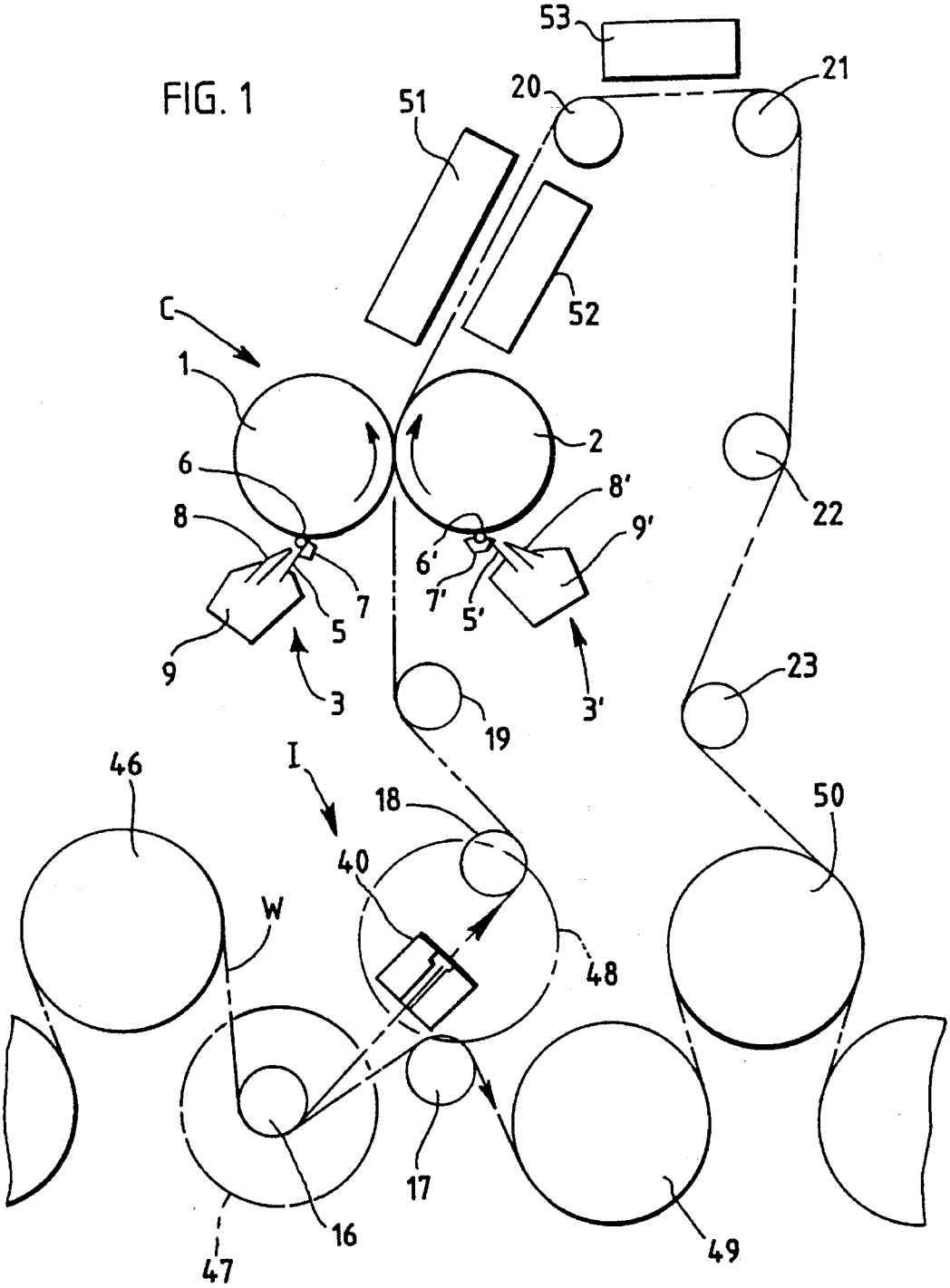
FIG. 1 is a schematic view of a device according to the invention.

A device according to the invention may suitably be incorporated into an existing machine having a group of drying cylinders and cooperating application devices. The inclusion of the inventive device into an existing machine results in only a slight increase in the entire machine length. A device according to the invention allows for the switching of a web conveyance path so as to bypass a coating application device. The means for bypassing the coating device is disposed in an area that corresponds at most to twice the diameter of a drying cylinder. The coating device is typically disposed above this intermediate space. Preferably, dryers are disposed downstream of the coating device which heat the material web utilizing infrared radiation or hot air. If an existing machine is altered to result in a device according to the invention, two neighboring drying cylinders merely must be removed to create the intermediate space and appropriate deflecting guide rolls may then be positioned in the intermediate space.

A device according to the invention is shown in FIG. 1. The device includes a drying group including a plurality of drying cylinders, preferably having about the same diameter, of which cylinders 46, 49, and 50 are shown. The circles shown in phantom and designated 47 and 48 represent two drying cylinders removed from an existing device to provide an intermediate space I for elements of a device according to the invention. The reference numerals 46–50 may also correspond to the continuous numbering of drying cylinders in a paper machine. The drying group shown in FIG. 1 includes two upper and lower rows of drying cylinders. The cylinders 46 and 50 are shown in the upper row and the cylinder 49 is shown in the lower row. An embodiment of the invention (not shown) may include an arrangement of the drying cylinders wherein the cylinder 46 is in the lower row and the cylinder 49 is in the upper row. With respect to the direction of conveyance of a material web through the machine, the cylinder 46 is upstream of the intermediate space I and the cylinder 49 is downstream of the intermediate space I.

A deflecting or guide roll 16 is disposed in the intermediate space I downstream of the drying cylinder 46, with respect to the direction of conveyance of a material web W through the machine. As shown in FIG. 1, a material web W may be conveyed from the drying cylinder 46 into the intermediate space I by the deflecting roll 16 and then by deflecting or guide rolls 18 and 19 to a coating device C. Alternatively, the web of material W may be conveyed from the drying cylinder 46 into the intermediate space I by the deflecting roll 16 and then by a another deflecting guide roll 17 also disposed in the intermediate space I to the drying cylinder 49, thus bypassing the coating device C. Preferably, a device described with respect to FIG. 1 is utilized with material webs made from paper or cardboard.

The coating device C preferably consists of two press-gap-forming press rolls, also known as web guide rolls 1 and 2. Coating application devices, generally 3 and 3', cooperate with the guide rolls 1 and 2, respectively. The application device 3 includes a coating blade or blade holder 5 attached to a bed support 7 which holds a doctor roll 6. A damping plate 8 is also mounted on the device 3 and is disposed in front of a surface of the press roll 1 upstream of the doctor roll 6. Coating material from a coating chamber 9 is applied to the cylinder 1 at a space formed between the damping plate 8 and the doctor roll 6. The coating material in the coating chamber 9 is preferably at a pressure greater than atmospheric pressure.

The coating application devices 3 and 3' are substantially identically constructed in mirror-image fashion. Therefore, the elements of the application device 3' designated by the reference numerals 5', 6', 7', 8', and 9' are substantially identical in design and function to the elements 5, 6, 7, 8, and 9 of the application device 3. Each web guide roll 1 and 2 rotates with the coating applied thereon by the application devices 3 and 3' being transported into the press-gap formed therebetween through which a material web is conveyed, thus coating the material web.

A plane running through a rotational axis of each web guide roll 1 and 2 preferably deviates at most 20° from the horizontal.

Downstream of the coating device C are heating installations 51, 52, and 53, which can operate based on infrared heating or with hot air.

Downstream of the heating installations are deflecting rolls 21, 22, and 23 which guide the coated and predried web W to the drying cylinder 50 and any other drying cylinders (not shown) required to completely dry the material web W.

The coating device C can only be utilized with a web of material that is substantially dry, i.e. at least 75%, and preferably at least 80% of the moisture should be removed from the material prior to coating. Moisture measuring equipment 40 is disposed between the guide rolls 16 and 18.

The coating device C is suitable for impregnating the web of material W with sizing or for coating with a pigment.

The rolls 1 and 2 of the coating device are preferably disposed on a higher machine floor or on a machine foundation which is on a higher tier than the drying cylinder group (rolls 46, 49 and 50).

A device according to the invention preferably provides a very short web conveyance path when bypassing the coating device because the distance between the drying cylinders at either side of the intermediate space I is at most two diameters in length, based on a series arrangement of the drying cylinders.

An advantage of the device according to the invention is that, when a web tears at the coating machine, it can be simply passed into a lower level of the machine before threading it in again. When an existing machine is rebuilt to provide a device according to the invention which allows for the bypassing of a coating machine, all that is lost is the heating performance of the two drying cylinders 47 and 48.

The foregoing detailed description is given for clearness of understanding only, and no unnecessary limitations should be understood therefrom, as modifications within the scope of the invention will be apparent to those skilled in the art.

I claim:

1. A device for treating material webs comprising first and second neighboring drying cylinders separated by an intermediate space, said intermediate space having a length equal to at most twice the diameter of at least one of the first and second cylinders, at least a first deflecting roll disposed in the intermediate space and in a path of a material web being conveyed through the device, and at least a second deflecting roll disposed below a coating device and above the intermediate space, said second deflecting roll being adapted to introduce a web of material upwardly into the coating device.

2. The device of claim 1 wherein the coating device comprises at least two web guide rolls and wherein a plane running through a rotational axis of each guide roll deviates at most 20° from the horizontal and that at most one application device cooperates with a cylindrical surface of each web guide roll, the application device being adapted to transfer a coating material onto the cylindrical surface of the respective web guide roll, the roll being adapted to transport the coating into a press-gap formed between the two web guide rolls and then onto a material web conveyed therethrough.

3. The device of claim 1 wherein the coating device is disposed above the drying cylinders.

4. The device of claim 1 comprising upper and lower rows of drying cylinders and wherein one of the first and second drying cylinders is disposed in the upper row and the other drying cylinder is disposed in the lower row.

5. The device of claim 4 wherein with respect to the direction of conveyance of a web of material through the device, the first drying cylinder is disposed upstream of the intermediate space and the second drying cylinder is disposed downstream of the intermediate space and two deflecting rolls are disposed in the intermediate space and are adapted to convey a material web directly from the first drying cylinder to the second drying cylinder.

6. The device of claim 5 wherein the first drying cylinder is disposed in the upper row and the second drying cylinder is disposed in the lower row.

* * * * *